US008991157B2

(12) United States Patent
Mastbergen et al.

(10) Patent No.: US 8,991,157 B2
(45) Date of Patent: Mar. 31, 2015

(54) DUAL AIR CIRCUIT FOR EXHAUST GAS TREATMENT

(75) Inventors: Daniel B. Mastbergen, Loveland, CO (US); Clark Fraser Paterson, Loveland, CO (US); John Michael Williams, Fort Collins, CO (US); Lawrence Dalimonte, Bath, MI (US); Nicholas Morley, Pinckney, MI (US); Tom DePotter, Rochester Hills, MI (US); Jagandeep Sandhu, Canton, MI (US)

(73) Assignee: Woodward, Inc., Fort Collins, CO (US)

( * ) Notice: Subject to any disclaimer, the term of this patent is extended or adjusted under 35 U.S.C. 154(b) by 422 days.

(21) Appl. No.: 13/361,378

(22) Filed: Jan. 30, 2012

(65) Prior Publication Data

US 2012/0192547 A1 Aug. 2, 2012
US 2013/0312388 A9 Nov. 28, 2013

Related U.S. Application Data

(60) Provisional application No. 61/437,896, filed on Jan. 31, 2011, provisional application No. 61/439,534, filed on Feb. 4, 2011.

(51) Int. Cl.

| | |
|---|---|
| ***F01N 3/00*** | (2006.01) |
| ***F01N 3/025*** | (2006.01) |
| *F01N 3/30* | (2006.01) |
| *F01N 3/32* | (2006.01) |
| *F01N 3/36* | (2006.01) |

(52) U.S. Cl.

CPC . *F01N 3/025* (2013.01); *F01N 3/30* (2013.01); *F01N 3/323* (2013.01); *F01N 3/36* (2013.01); *F01N 2240/14* (2013.01); *F01N 2550/14* (2013.01)

USPC ..... 60/295; 60/286; 60/289; 60/303

(58) Field of Classification Search

CPC ..... F01N 3/025; F01N 3/30; F01N 2550/14; F01N 3/0256; F01N 3/023; F01N 3/2033; F01N 13/1855; F01N 13/1805; F01N 3/0821; F01N 3/0842; F01N 3/106; F01N 3/2066; F01N 3/035; F01N 9/002; F01N 11/00; F01N 3/0253; F02B 37/164; F02B 37/16

USPC ..... 60/272–324

See application file for complete search history.

(56) References Cited

U.S. PATENT DOCUMENTS 3,794,459 A * 2/1974 Meenan ..... 431/5
4,520,624 A * 6/1985 Kiyota et al. ..... 60/286

(Continued)

*Primary Examiner* — Audrey K Bradley
*Assistant Examiner* — Kelsey Stanek
(74) *Attorney, Agent, or Firm* — Reinhart Boerner Van Deuren P.C.

(57) ABSTRACT

An exhaust treatment system for an engine includes a regeneration device being in receipt of exhaust from the engine and positioned upstream of a diesel particulate filter. A compressor provides a source of compressed air. An air/fuel nozzle is coupled to the regeneration device, in receipt of a fuel supply as well as the compressed air. The fuel and compressed air are forced through an orifice of the nozzle to atomize the fuel. A bypass line provides compressed air from the compressor to the regeneration device without passing through the orifice of the nozzle. A valve is operable to allow compressed air to flow through the bypass line when a predetermined condition exists.

17 Claims, 4 Drawing Sheets

(56) References Cited

U.S. PATENT DOCUMENTS

| | | | | |
|---|---|---|---|---|
| 4,589,254 | A * | 5/1986 | Kume et al. | 60/286 |
| 7,032,376 | B1 * | 4/2006 | Webb et al. | 60/297 |
| 8,234,857 | B2 * | 8/2012 | McCombs | 60/295 |
| 8,429,903 | B2 * | 4/2013 | Charles et al. | 60/295 |
| 2008/0264046 | A1 | 10/2008 | Cornell et al. | |
| 2009/0183499 | A1 | 7/2009 | Boorse | |
| 2009/0313975 | A1 | 12/2009 | McCombs | |
| 2010/0139267 | A1 | 6/2010 | Schliesche et al. | |

* cited by examiner

DUAL AIR CIRCUIT FOR EXHAUST GAS TREATMENT

CROSS-REFERENCE TO RELATED PATENT APPLICATION

This patent application claims the benefit of U.S. Provisional Patent Application No. 61/437,896, filed Jan. 31, 2011, the entire teachings and disclosure of which are incorporated herein by reference thereto, and claims the benefit of U.S. Provisional Patent Application No. 61/439,534, filed Feb. 4, 2011.

FIELD OF THE INVENTION

The present disclosure generally relates to exhaust gas treatment systems. More particularly, a dual circuit secondary air system cooperates with a diesel particulate filter regeneration device to improve emissions control.

BACKGROUND OF THE INVENTION

This section provides background information related to the present disclosure which is not necessarily prior art.

Exhaust aftertreatment systems may include a diesel particulate filter for treating the exhaust of a diesel engine. In many applications, it may be beneficial to periodically regenerate or oxidize soot trapped within the diesel particulate filter. A regeneration device such as a burner may be positioned upstream of the diesel particulate filter. The burner is typically provided with a fuel such as a hydrocarbon, a supply of oxygen and one or more igniters. Combustion of the fuel within the burner increases the energy of the exhaust entering the diesel particulate filter. Oxidation of the soot trapped within the filter occurs during the regeneration process.

Some vehicles are equipped with compressors associated with engine superchargers or turbochargers. In some instances, the output from the compressor provides a secondary air supply to a nozzle useful for atomizing the fuel within the regeneration device. Because the compressor output is typically directly related to engine speed, the flow of compressed air to the nozzle varies greatly during engine operation. As such, an exhaust aftertreatment system properly designed for operation at relatively low to moderate engine speeds may not optimally function at an upper range of engine speeds.

For example, at high engine speeds, the output flow rate from the compressor is high. The resistance to air flow through the nozzle of the burner may be significant. A resistance to flow at the outlet of the compressor may undesirably load the compressor and increase the operating temperature of the compressor. Control systems may be required to assure that the compressor temperature does not exceed a predetermined maximum temperature. A maximum output pressure may be set. By limiting the compressor output, the flow rate of secondary air through the burner nozzle may be insufficient to heat the high volume of exhaust flowing through the burner. An undesirably low temperature at the diesel particulate filter inlet may result. Therefore, a need in the art may exist to provide a modified secondary air system for use with an exhaust gas aftertreatment system.

BRIEF SUMMARY OF THE INVENTION

This section provides a general summary of the disclosure, and is not a comprehensive disclosure of its full scope or all of its features.

An exhaust treatment system for an engine includes a regeneration device being in receipt of exhaust from the engine and positioned upstream of a diesel particulate filter. A compressor provides a source of compressed air. An air/fuel nozzle is coupled to the regeneration device, in receipt of a fuel supply as well as the compressed air. The fuel and compressed air are forced through an orifice of the nozzle to atomize the fuel. A bypass line provides compressed air from the compressor to the regeneration device without passing through the orifice of the nozzle. A valve is operable to allow compressed air to flow through the bypass line when a predetermined condition exists.

A method of treating exhaust from an engine includes compressing air using energy from the engine. A regeneration device is positioned upstream from a diesel particulate filter. Exhaust is passed through the regeneration device and the diesel particulate filter. The method includes providing a fuel and compressed air from the compressor to an air/fuel nozzle coupled to the regeneration device and providing a parallel path for compressed air from the compressor to the regeneration device bypassing the air/fuel nozzle to reduce the load on the compressor.

Further areas of applicability will become apparent from the description provided herein. The description and specific examples in this summary are intended for purposes of illustration only and are not intended to limit the scope of the present disclosure.

Other aspects, objectives and advantages of the invention will become more apparent from the following detailed description when taken in conjunction with the accompanying drawings.

BRIEF DESCRIPTION OF THE DRAWINGS

The drawings described herein are for illustrative purposes only of selected embodiments and not all possible implementations, and are not intended to limit the scope of the present disclosure.

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Example embodiments will now be described more fully with reference to the accompanying drawings.

Figure 1:
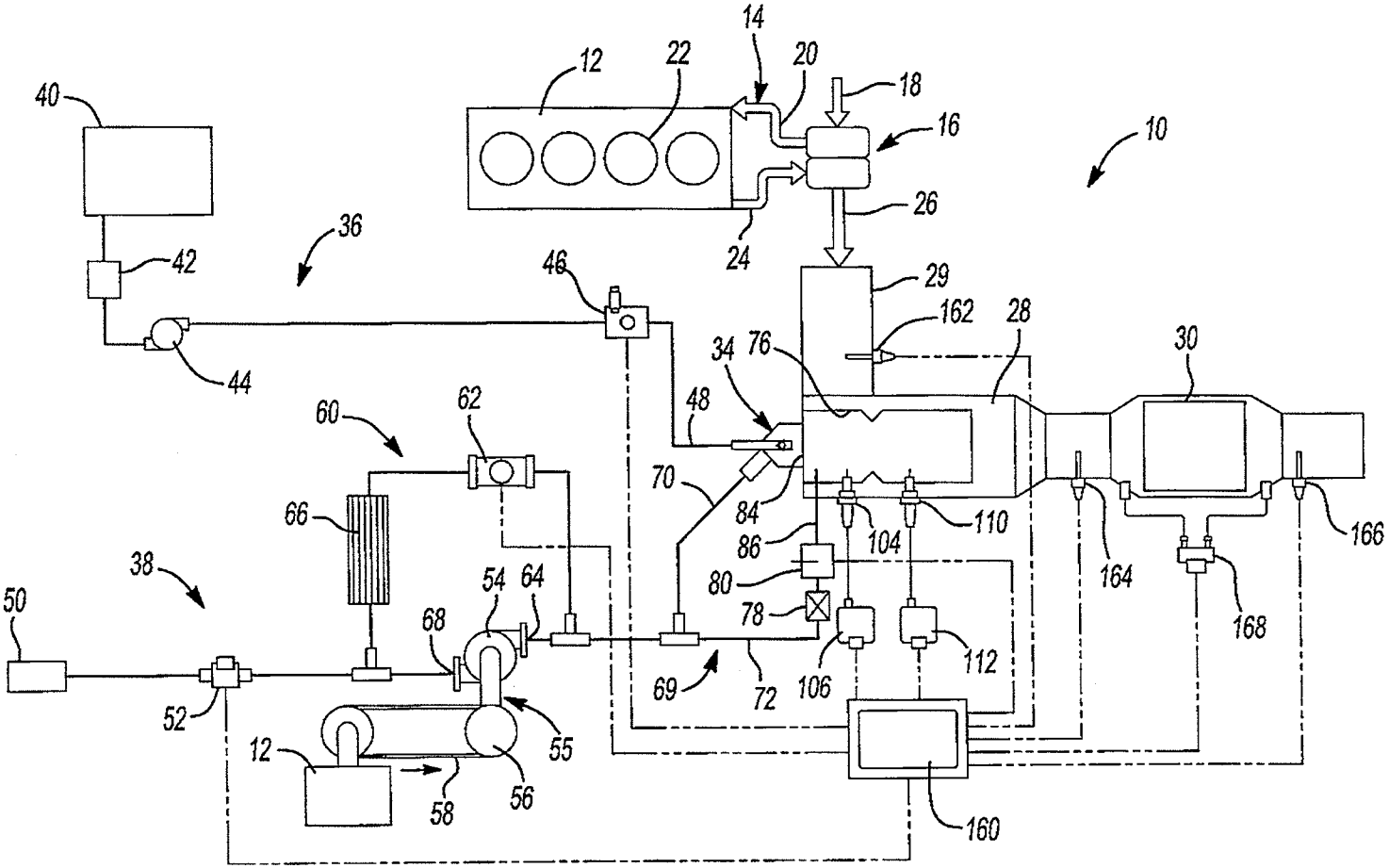
FIG. 1 is a schematic depicting a vehicle equipped with an exhaust treatment system constructed in accordance with the teachings of the present disclosure.

FIG. 1 provides a schematic of an exemplary vehicle 10 including an engine 12 associated with an intake system 14 and an exhaust system 16. Intake system 14 includes an inlet 18 for receiving outside air and an intake 20 for providing outside air to a plurality of combustion chambers 22. Exhaust from combustion chambers 22 is provided via an exhaust manifold 24 to an exhaust pipe 26. Exhaust system 16 also includes a regeneration device 28 having an inlet 29 in receipt of exhaust from exhaust pipe 26. A diesel particulate filter 30 is positioned downstream from and in fluid communication with regeneration device 28.

An air/fuel nozzle 34 is mounted to regeneration device 28 and plumbed in communication with a fuel delivery system 36 and a secondary air system 38. Fuel delivery system 36 includes a fuel tank 40, a fuel filter 42, a fuel pump 44 and a fuel block 46 interconnected by a fuel line 48. Operation of the components of fuel system 36 selectively provides hydrocarbons to air/fuel nozzle 34.

Secondary air system 38 includes a secondary air filter 50 and a MAF sensor 52. A compressor 54 is in receipt of air that has passed through secondary air filter 50 and MAF sensor 52. Compressor 54 may be a portion of one of a supercharger or a turbocharger. A supercharger 55 is shown including an input 56 driven by engine 12 via a flexible member 58.

Secondary air system 38 also includes a recirculation loop 60 having a bypass air throttle 62 in receipt of compressed air from an outlet 64 of compressor 54. Air passing through bypass air throttle 62 is cooled by flowing through an intercooler 66. An outlet of intercooler 66 is in communication with an inlet 68 of compressor 54.

Secondary air system 38 also includes dual supply circuit 69 having a primary passageway 70 providing compressed air from compressor outlet 64 to air/fuel nozzle 34. A secondary passageway 72 is provided to allow communication between outlet 64 of compressor 54 and a primary combustion zone 76 of regeneration device 28. Air passing through secondary passageway 72 bypasses air/fuel nozzle 34. A check valve 78 and a control valve 80 are positioned within secondary passageway 72 to control the flow of fluid passing therethrough.

Figure 2:
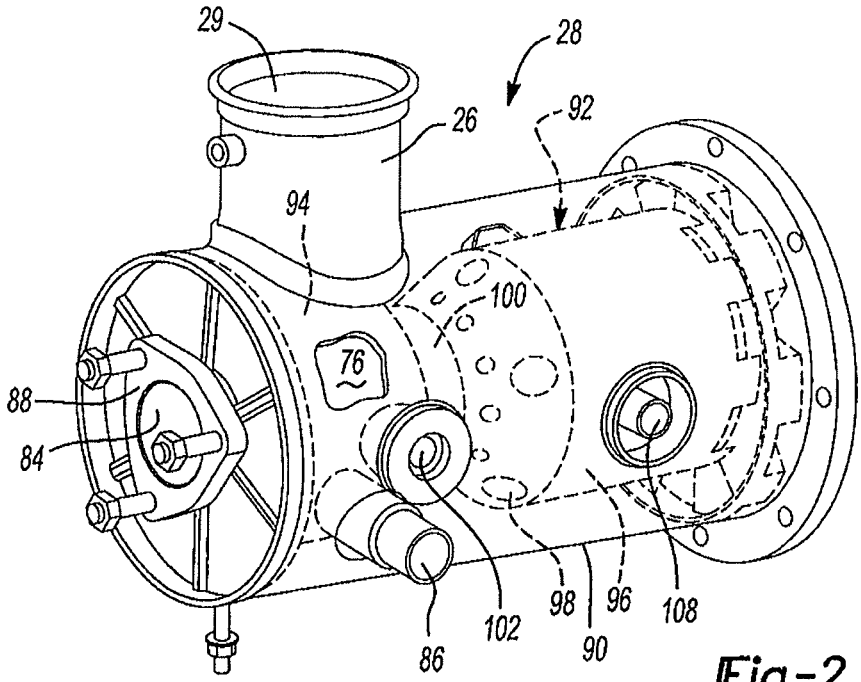
FIG. 2 is a perspective view of an exemplary regeneration device.

FIG. 2 depicts regeneration device 28 including exhaust inlet 29, a first air inlet 84 and a second air inlet 86. A mount 88 is associated with first air inlet 84 and is operable to couple air/fuel nozzle 34 to regeneration device 28. Second air inlet 86 is spaced apart from air/fuel nozzle 34 and positioned in communication with primary combustion zone 76.

Regeneration device 28 includes a housing 90 circumferentially surrounding a combustion tube 92. Combustion tube 92 includes a first portion 94 defining primary combustion zone 76, a second portion 96 defining a secondary combustion zone 98 and a necked portion 100 having a reduced diameter interconnecting first portion 94 and second portion 96. An aperture 102 extends through housing 90 and first portion 94 to provide access to primary combustion zone 76. As shown in FIG. 1, a primary igniter 104 is positioned within primary combustion zone 76. A primary coil 106 provides energy to igniter 104 for initiation of combustion of the air/fuel mixture provided by air/fuel nozzle 34. An aperture 108 extends through housing 90 and second portion 96 to allow a second igniter 110 to be positioned in communication with secondary combustion zone 98. A secondary coil 112 is operable to provide energy to second igniter 110.

Figure 3:
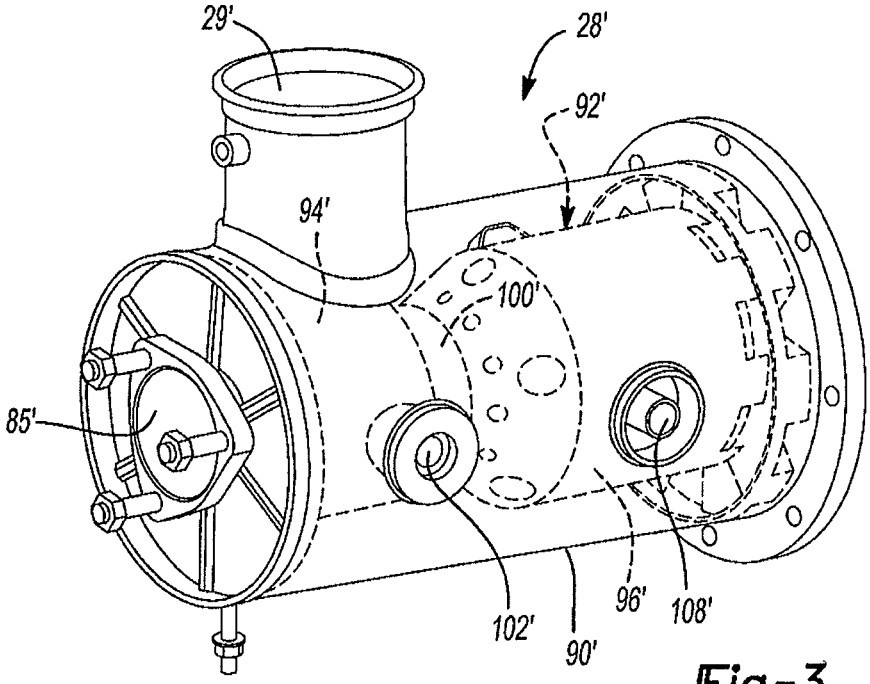
FIG. 3 is a perspective view of another regeneration device.

FIG. 3 depicts an alternate regeneration device identified at reference numeral 28'. Regeneration device 28' is substantially similar to regeneration device 28 except that both first air inlet 84 and second air inlet 86 extend through a common aperture 85'. Similar elements are identified with like reference numerals including a prime suffix.

Figure 4:
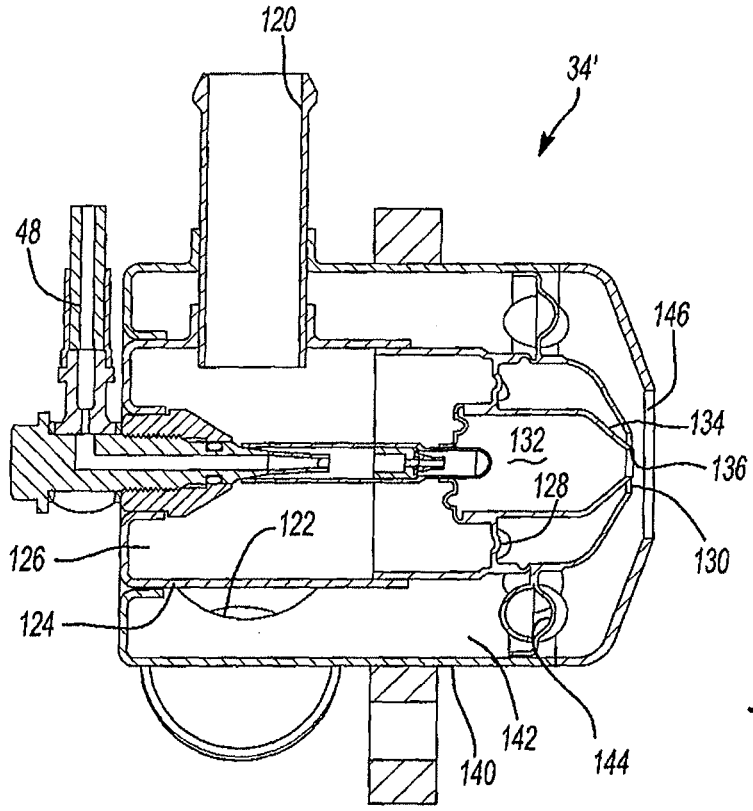
FIG. 4 is a cross-sectional view of an air/fuel nozzle.

A modified air/fuel nozzle 34' is shown in FIG. 4 for use with regeneration device 28'. Air/fuel nozzle 34' includes a first air inlet 120 as well as a second air inlet 122. First air inlet 120 is in fluid communication with primary passageway 70. Second air inlet 122 receives a secondary air supply from secondary passageway 72. Air/fuel nozzle 34' also includes a housing 124 defining an inner cavity 126. First air inlet 120 includes an end in communication with inner cavity 126. Fuel line 48 is coupled to housing 124 and configured to inject fuel within an inner chamber 132. Secondary air provided via first air inlet 120 passes through a first swirler 128 and exits at an orifice 130. Fuel provided via line 48 does not pass through swirler 128 but passes through inner chamber 132 defined by an inner wall 134. Fuel exits through an orifice 136 extending through inner wall 134. Orifices 130 and 136 are concentrically aligned to atomize the fuel upon exit.

Air/fuel nozzle 34' also includes a shroud 140 surrounding housing 124. Second air inlet 122 provides air to an annular cavity 142 formed between housing 124 and shroud 140. The air provided via secondary passageway 72 passes through a swirler 144 and exits air/fuel nozzle 34' at an aperture 146. Aperture 146 is substantially larger than orifice 130 thereby producing a greatly reduced delta pressure across air/fuel nozzle 34' than the secondary air passing through orifice 130. Aperture 146 is aligned with orifices 130 and 136 to allow fuel and both sources of secondary air to exit air/fuel nozzle 34' and enter primary combustion zone 76. The manner in which air from secondary passageway 72 travels through cavity 142 and across housing 124 provides cooling and shielding from the heat generated within primary combustion zone 76.

In operation, engine 12 is operable across a wide range of speeds and loads. At low to moderate engine speed and load operating conditions, bypass air throttle 62 may be controlled to recirculate a portion of the secondary air output from compressor 54 with the remainder of the output from the compressor being provided to and passing through primary passageway 70. At this time, control valve 80 is closed and secondary air does not pass through secondary passage 72. During the low to moderate load operation, the load on compressor 54 based on the restriction to secondary air flow through air/fuel nozzle 34 is moderate. As such, compressor 54 is not prone to overheating during these operation modes.

A controller 160 actively controls bypass air throttle 62. Controller 160 may also receive and manipulate data provided by a first temperature sensor 162 located upstream of regeneration device 28, a second temperature sensor 164 located downstream of regeneration device 28 and upstream of diesel particulate filter 30 and a third temperature sensor 166 positioned downstream of diesel particulate filter 30. A pressure differential sensor 168 may output a signal indicative of the pressure differential across diesel particulate filter 30. Controller 160 may utilize the information provided by the sensors described above as well as MAF sensor 52. Other information may be available from the vehicle controller such as signals indicative of engine speed, ambient temperature, vehicle speed, engine coolant temperature, oxygen content and any number of other vehicle parameters.

Based on the information provided to controller 160, regeneration device 28 may be selectively operated to regenerate diesel particulate filter 30 when the appropriate set of conditions are present. In one example, regeneration occurs when sensor 168 indicates a pressure differential greater than a predetermined value exists across diesel particulate filter 30. At this time, fuel block 46 is controlled to allow fuel to pass through fuel line 48 to air/fuel nozzle 34. Bypass air throttle 62 is controlled to provide sufficient supply of secondary air to primary passageway 70. Coil 106 and coil 112 may be energized to initiate combustion by generating a spark at primary igniter 104 and secondary igniter 110.

During engine operation at relatively high speed and/or load, the output from compressor 54 may be too large to pass the entire flow rate through primary passageway 70 without greatly increasing the load on compressor 54. As the pressure within secondary passageway increases to a predetermined magnitude, control valve 80 opens to allow secondary air to pass through secondary passageway 72. As previously mentioned, control valve 80 may be a passive pressure relief valve having a predetermined crack pressure or alternatively may be solenoid actuated via control module 160 as an on/off valve. Valve 80 may be actively controlled to vary the pressure by selectively controlling the valve to a number of positions between a fully open position and a fully closed position.

Figure 5:
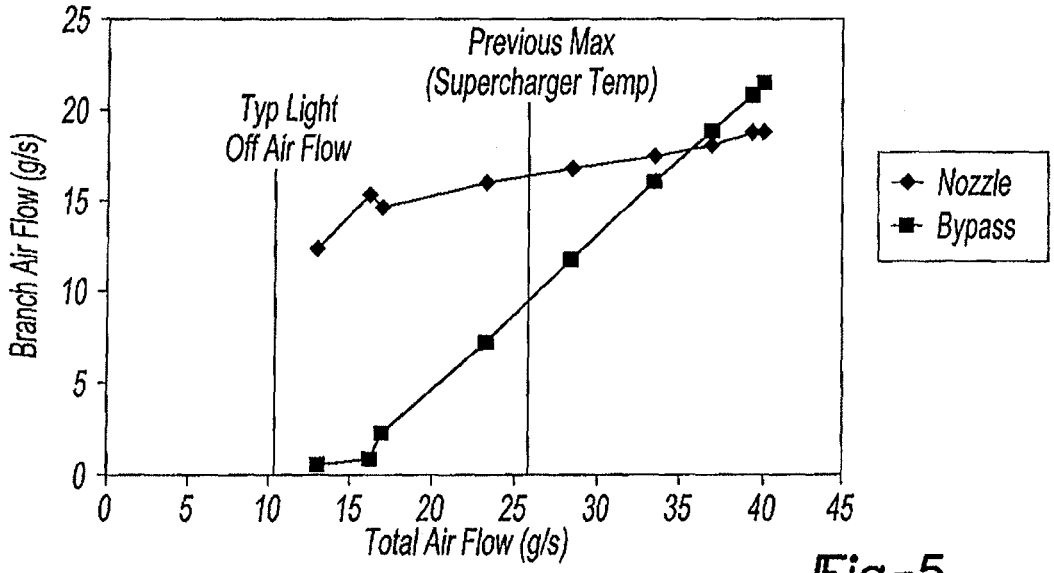
FIG. 5 is a graph depicting flow through portions of a secondary air system of the exhaust treatment device.

It should be appreciated that valve 80 may allow air to pass through secondary passageway 72 regardless of the energization state of primary igniter 104 and secondary igniter 110. FIG. 5 plots the flow of secondary air through primary passageway 70 and secondary passageway 72 as the total air flow provided by compressor 54 increases. As previously described, during typical light to moderate engine speeds, the output from compressor 54 will also be relatively low. At this time, little to no air flow occurs through secondary passageway 72 and the total air flow equals the amount of air flow through primary passageway 70. Once a predetermined pressure is reached, valve 80 opens and secondary air flows through both primary passageway 70 and secondary passageway 72. FIG. 5 depicts the performance of dual supply circuit 69 being fitted with valve 80 having a crack pressure of approximately 17 kPa. It should be appreciated that total air flow was previously limited to approximately 26 g/s within a system absent secondary passageway 72. This limit was set based on a maximum operating temperature of compressor 54. Using the secondary air system of the present disclosure, the maximum operating temperature of the compressor 54 is not reached due to the reduction in load and substantial flow passing through secondary passageway 72. Total air flow rates ranging up to at least 40 g/s may be provided.

Figure 6:
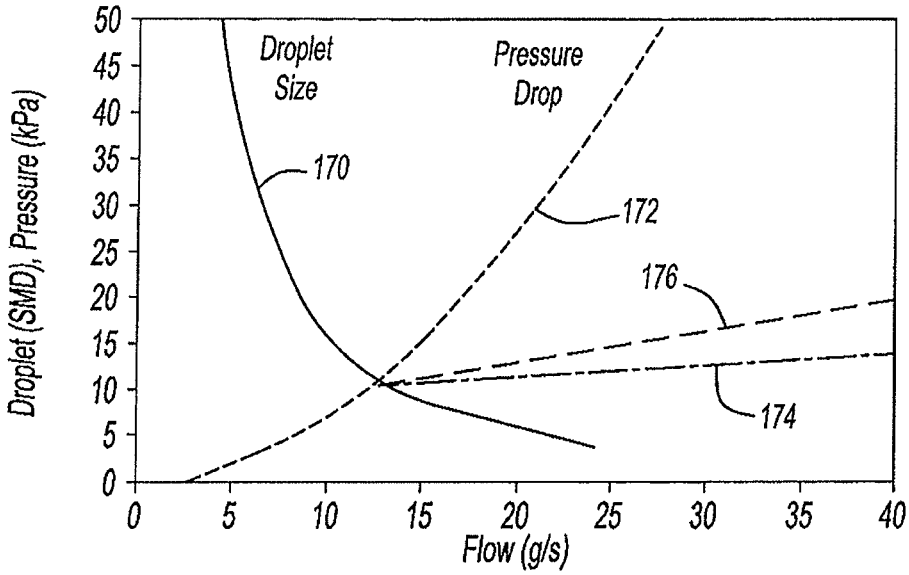
FIG. 6 is a nozzle flow curve for a secondary air system equipped with a 10 kPa pressure relief valve.

FIG. 6 depicts a nozzle flow curve showing fuel droplet size per flow rate as well as pressure drop across air/fuel nozzle 34 as the flow through primary passageway 70 increases. A first trace 170 represents fuel droplet size in the system where all of the secondary air passes through primary passageway 70. Trace 172 is the corresponding pressure drop of air passing through air/fuel nozzle 34. Trace 174 represents fuel droplet size in a system constructed in accordance with the teachings of the present disclosure having a pressure relief valve located within secondary passageway 72. The cracking pressure of the pressure relief valve 80 is approximately 10 kPa. A trace 176 represents the pressure drop across air/fuel nozzle 34 in a system equipped with a 10 kPa pressure relieve valve. When reviewing traces 170, 172, it should be noted that a relatively narrow operating range of total flow is defined due to a requirement of regeneration device 28 properly functioning with a fuel droplet size of 25 SMD or less. This droplet size corresponds to a flow rate through primary passageway 70 of approximately 7 g/s. An upper limit of the operating range was previously defined by the overheating condition of compressor 54 limiting air flow through primary passageway 70 to approximately 26 g/s.

Use of secondary passageway 72 and control valve 80 substantially expands the total flow operating range. As shown in traces 174, 176, droplet size ranges from 10 to 14 SMD throughout a flow rate of approximately 13 to 40 g/s. Furthermore, the pressure drop across air/fuel nozzle 34 very gradually increases from 10 kPa to approximately 20 kPa as total flow ranges from 13 g/s to 40 g/s.

Figure 7:
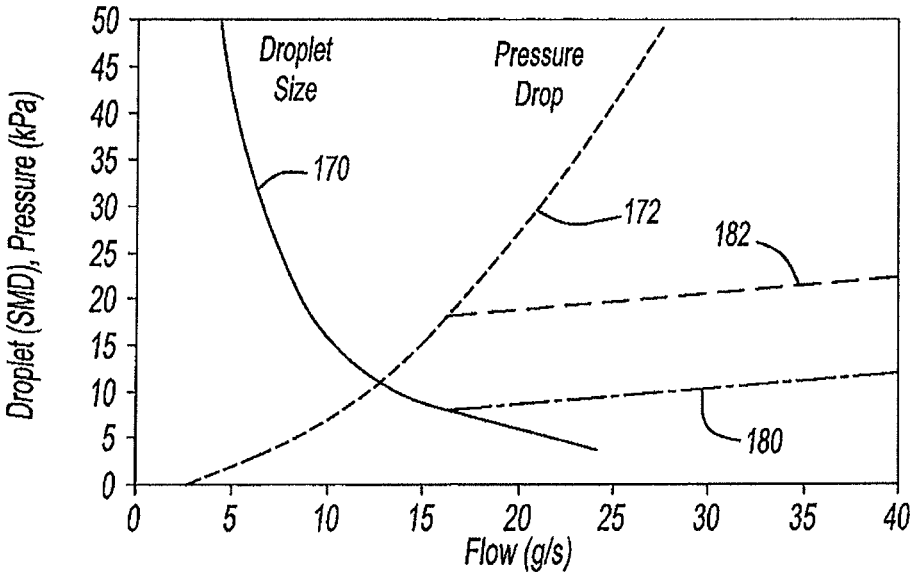
FIG. 7 is a nozzle flow curve for a secondary air system equipped with a 17 kPa pressure relief valve.

FIG. 7 depicts another alternate secondary air system having control valve 80 set at a crack pressure of 17 kPa. In this arrangement, a trace 180 represents droplet size while trace 182 represents pressure drop associated with the use of the 17 kPa cracking pressure relief valve. The 17 kPa pressure relief valve increases the pressure drop but maintains the pressure drop within a range to avoid overheating compressor 54. The increase in pressure drop allows more air flow through the atomization nozzle thereby producing a reduced droplet size. Reduced droplet size is beneficial to the ease of operation of regeneration device 28. From reviewing FIGS. 6 and 7, it should be appreciated that any number of similar systems may be defined to particularly tailor the cracking pressure of control valve 80 to the geometry of any number of air/nozzles 34 to greatly expand the useful range of regeneration device 28.

With the operation range of regeneration device 28 being expanded to a total flow ranging from approximately 7 g/s through 40 g/s, light off may be achieved within primary combustion zone 76 throughout substantially the entire operating range of engine 12 from idle speed to wide open throttle. Viewed another way, a common air/fuel nozzle 34 may be implemented within a number of different systems having different engines, superchargers or compressors. The cracking pressure or control of valve 80 may be varied to assure proper flow through both primary passageway 70 and secondary passageway 72.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An exhaust treatment system for an engine, comprising:

a diesel particulate filter;

a regeneration device to receive exhaust from the engine and being positioned upstream of the diesel particulate filter;

a compressor providing a source of compressed air;

an air/fuel nozzle coupled to the regeneration device, being in receipt of a fuel supply and the compressed air, the fuel and compressed air being forced through an orifice of the nozzle to atomize the fuel;

a bypass line providing compressed air from the compressor to the regeneration device without passing through the orifice of the nozzle; and a valve operable to allow compressed air to flow through the bypass line when a predetermined condition exists.

2. The exhaust treatment system of claim 1 wherein a load on the compressor is reduced when the valve is open.

3. The exhaust treatment system of claim 2 wherein the valve includes a passive pressure relief valve.

4. The exhaust treatment system of claim 2 wherein the valve includes a solenoid for varying flow through the bypass line.

5. The exhaust treatment system of claim 1 further including a check valve restricting flow in the bypass line from the regeneration device toward the compressor.

6. The exhaust treatment system of claim 1 wherein the predetermined condition includes a compressed air pressure in the bypass line exceeding a predetermined value.

7. The exhaust treatment system of claim 1 wherein the regeneration device includes a primary combustion zone in receipt of the fuel and compressed air flowing through the orifice as well as the compressed air passing through the bypass line.

8. The exhaust treatment system of claim 1 further including an igniter positioned within the primary combustion zone to initiate combustion of the fuel.

9. The exhaust treatment system of claim 1 wherein the compressor is adapted to be driven by the engine.

10. The exhaust treatment system of claim 1 wherein the predetermined condition includes exceeding a 10 kPa pressure in the bypass line.

11. A method of treating exhaust from an engine, comprising:

compressing air using energy from the engine;

positioning a regeneration device upstream from a diesel particulate filter;

passing exhaust through the regeneration device and the diesel particulate filter;

providing a fuel and compressed air from the compressor to an air/fuel nozzle Coupled to regeneration device; and providing a parallel path for compressed air from the compressor to the regeneration device bypassing the air/fuel nozzle to reduce the load on the compressor.

12. The method of claim 11 further including positioning a normally closed valve within the parallel path and supplying the compressed air to the regeneration device through the valve when a predetermined condition exists.

13. The method of claim 12 wherein the predetermined condition includes a compressed air pressure in the parallel path exceeding a predetermined value.

14. The method of claim 13 wherein the fuel and compressed air provided to the air/fuel nozzle are forced through an orifice of the nozzle to atomize the fuel.

15. The method of claim 14 further including mixing the atomized fuel with the compressed air provided via the parallel path within a primary combustion zone of the regeneration device.

16. The method of claim 15 further including igniting the atomized fuel within the primary combustion zone.

17. The method of claim 13 wherein the predetermined value of pressure within the parallel path includes 10 kPa.

* * * * *